US008402952B2

(12) United States Patent
Haaf et al.

(10) Patent No.: US 8,402,952 B2
(45) Date of Patent: Mar. 26, 2013

(54) METHOD FOR CONTROLLING A SOLENOID VALVE OF A QUANTITY CONTROLLER IN AN INTERNAL COMBUSTION ENGINE

(75) Inventors: Gerhard Haaf, Stuttgart (DE); Timm Hollmann, Benningen (DE); Christian Wiedmann, Ludwigsburg (DE); Joerg Kuempel, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 122 days.

(21) Appl. No.: 12/670,890

(22) PCT Filed: Jul. 17, 2008

(86) PCT No.: PCT/EP2008/059400

§ 371 (c)(1),
(2), (4) Date: Jan. 27, 2010

(87) PCT Pub. No.: WO2009/016044

PCT Pub. Date: Feb. 5, 2009

(65) Prior Publication Data

US 2010/0237266 A1 Sep. 23, 2010

(30) Foreign Application Priority Data

Jul. 27, 2007 (DE) ..... 10 2007 035 316

(51) Int. Cl.
*F02M 37/04* (2006.01)
*F02M 37/00* (2006.01)

(52) U.S. Cl. ..... 123/499; 123/511

(58) Field of Classification Search ..... 123/499, 123/458, 506, 510, 508, 511; 361/154, 152, 361/160; 251/129.15
See application file for complete search history.

(56) References Cited

U.S. PATENT DOCUMENTS

| | | | | |
|---|---|---|---|---|
| 5,803,049 | A | 9/1998 | Harcombe | |
| 5,924,435 | A * | 7/1999 | Wall et al. | 137/1 |
| 5,959,825 | A * | 9/1999 | Harcombe | 361/154 |
| 6,332,454 | B1 * | 12/2001 | Itabashi et al. | 123/490 |
| 6,446,610 | B1 * | 9/2002 | Mazet | 123/497 |
| 7,293,548 | B2 * | 11/2007 | Oono | 123/446 |
| 7,363,918 | B2 * | 4/2008 | Majima | 123/514 |
| 2004/0237938 | A1 * | 12/2004 | Oono et al. | 123/457 |
| 2005/0011496 | A1 * | 1/2005 | Dolker | 123/458 |
| 2005/0045158 | A1 * | 3/2005 | Takahashi | 123/506 |
| 2005/0211224 | A1 | 9/2005 | Inaguma et al. | |

FOREIGN PATENT DOCUMENTS

| | | |
|---|---|---|
| EP | 1 898 085 | 3/2005 |
| JP | 9-151768 | 6/1997 |
| JP | 11-229938 | 8/1999 |
| JP | 2001-182593 | 7/2001 |

(Continued)

*Primary Examiner* — Mahmoud Gimie
(74) *Attorney, Agent, or Firm* — Merchant & Gould P.C.

(57) ABSTRACT

A method for controlling a fuel injection system (10) of an internal combustion engine. Including a high-pressure pump (16) associated with a quantity controlling valve (15) having a solenoid valve (22) electromagnetically actuatable by a coil (21) for supplying fuel, the quantity control valve (15) controlling the quantity of fuel supplied by the high-pressure pump (16) and the coil (21) of the solenoid valve (22) having a first current value applied thereto, in order to close the same for supplying fuel to the high-pressure pump (16), the first current value being reduced to a second current value when the solenoid valve is closing (22), such that the radiation of audible sound arising from the closing of the solenoid valve (22) is at least partially reduced.

12 Claims, 5 Drawing Sheets

FOREIGN PATENT DOCUMENTS

| | | |
|---|---|---|
| JP | 2005-344573 | 12/2005 |
| JP | 2006-250086 | 9/2006 |
| JP | 2007-146657 | 6/2007 |
| WO | WO 2004/007934 | 1/2004 |
| WO | WO 2006/060545 | 6/2006 |

* cited by examiner

METHOD FOR CONTROLLING A SOLENOID VALVE OF A QUANTITY CONTROLLER IN AN INTERNAL COMBUSTION ENGINE

This application is a National Stage Application of PCT/EP2008/059400, filed 17 Jul. 2008, which claims benefit of Serial No. 10 2007 035 316.4, filed 27 Jul. 2007 in Germany and which applications are incorporated herein by reference. To the extent appropriate, a claim of priority in made to each of the above disclosed applications.

TECHNICAL FIELD

The present invention relates to a method for controlling a fuel injection system of an internal combustion engine, the fuel injection system comprising a high-pressure pump associated with a quantity controlling valve having a solenoid valve electromagnetically actuatable by a coil for supplying the fuel, the quantity control valve controlling the quantity of fuel supplied by the high-pressure pump and the coil of the solenoid valve having a first current value applied thereto, in order to close the same for supplying fuel to the high-pressure pump.

A method for controlling a fuel injection system with a quantity control valve is already known from the technical field. Such a quantity control valve is implemented as a rule as a solenoid valve electromagnetically acuatable by a coil and having a magnetic armature and associated displacement limiting stops. The solenoid valve is open when no power is present. In order to close the solenoid valve, the coil is activated with a constant voltage—battery voltage—the current in the coil increasing in a characteristic manner. After switching off the voltage, the current drops in turn in a characteristic manner, and the solenoid valve opens shortly after the current has dropped. The time between switching off the voltage at the coil and the opening of the valve is designated as discharging time.

In order to reduce the discharging time, the voltage applied to the coil can be reduced when the solenoid valve is closing and before the same achieves a corresponding end position, i.e. before the magnetic armature touches against the displacement limiting stops. In so doing, the current in the coil and consequently also the magnetic force are rapidly increased by the voltage which was initially applied in order to achieve a quick onset of movement of the magnetic armature. An unnecessary increase in the current in the coil is then avoided by reducing the applied voltage. This reduction in voltage can take place both prior to as well as after a specified force value has been achieved, whereat the magnetic armature begins to move. It is important in this case that a reliable attraction of the magnetic armature is assured.

In the event that the current supply to the solenoid valve is set too low during the operation of such a fuel injection system, its actuation time can possibly be lengthened to such an extent that the magnetic valve does not completely close in a provided actuation time, and as a result a sufficient high pressure cannot be built up in the high-pressure pump. In order to avoid this, the current supply is defined in a way that a closing of the solenoid valve is always assured. If the defined current supply is, however, frequently set so high that the actuation behavior of the solenoid valve is relatively high and as a result a correspondingly high speed at impact of the magnetic armature against the displacement limiting stops occurs, a hard striking of the magnetic armature against the displacement limiting stops then results. In so doing, an audible sound arises, which is radiated by the internal combustion engine and which can be perceived by the operator to be unpleasant and disturbing.

SUMMARY

It is therefore the task of the present invention to provide a method and a device, which allow for a reduction in the audible sound when solenoid valves of a quantity control valve are actuated.

This problem is solved by a method for controlling a fuel injection system of an internal combustion engine. The fuel injection system comprises a high-pressure pump, which is associated with a quantity control valve having a solenoid valve electromagnetically acuatable by a coil for supplying fuel to said pump. The quantity control valve controls the quantity of fuel supplied by the high-pressure pump. The coil of the solenoid valve has a first current value applied thereto in order to close the same for supplying fuel to the high-pressure pump. When the solenoid valve is closing, the first current value is reduced to a second current value in such a way that a radiation of audible sound arising from the closing of the solenoid valve during operation of the internal combustion engine is at least partially reduced.

The invention consequently allows for a reduction in the audible sound during the operation of the internal combustion engine so that said engine is subjectively perceived to be more pleasant and quieter.

According to the invention, the second current value corresponds to a minimum current value, with which a complete closing of the solenoid valve can be achieved during the operation of the internal combustion engine.

A maximum reduction in the audible sound can consequently be achieved.

The high-pressure pump is connected to a pressure reservoir, whereat at least one fuel injection valve is attached. Here an actual pressure value is compared with an associated nominal pressure value. In order to determine the minimum current value, a malfunction current value is preferably ascertained, whereat the deviation of the actual pressure value from the nominal pressure value exceeds a predetermined threshold value, the ascertained malfunction current value being increased by a predetermined safety offset.

A complete closing of the solenoid valve is assured by the increase in the ascertained malfunction current value by the predetermined safety offset.

A nominal pressure value required for operation can alternatively be predetermined for the high-pressure pump, which is connected to a pressure reservoir, whereat at least one fuel injection valve is attached, from an associated pressure controller, the minimum current value being determined as a function of an increase in the nominal pressure value during the operation of the internal combustion engine. In so doing, a malfunction current value, whereat the increase in the nominal pressure value exceeds a predetermined threshold value, is ascertained for determining the minimum current value, the ascertained malfunction value being increased by a predetermined safety offset.

The invention can therefore be implemented using already available components and elements, a complete closing of the solenoid valve being assured by the increase in the ascertained malfunction current value by the predetermined safety offset.

According to the invention, the solenoid valve has a magnetic armature, which is drawn against associated displacement limiting stops in order to close the solenoid valve, the audible sound occurring by the striking of the magnetic armature against the displacement limiting stops. At this juncture, an actuation behavior of the solenoid valve is decelerated by reducing the first current value to a second current value in order to reduce a corresponding speed at impact of the magnetic armature against the displacement limiting stops.

By reducing the speed at impact, the audible sound produced when the magnetic armature impacts against the displacement limiting stops is reduced.

The problem mentioned at the beginning of the application is also solved by a computer program for carrying out a method for controlling a fuel injection system of an internal combustion engine, the fuel injection system comprising a high-pressure pump associated with a quantity control valve having a solenoid valve electromagnetically actuatable by a coil for supplying fuel, the quantity control valve controlling the quantity of fuel supplied by the high-pressure pump and the coil of the solenoid valve having a first current value applied thereto in order to close the same for supplying fuel to the high-pressure pump. The computer program reduces the first current value to a second current value when the solenoid valve is closing, such that a radiation of audible sound arising from the closing of the solenoid valve during operation of the internal combustion engine is at least partially reduced.

The problem mentioned at the beginning of the application is also solved by an internal combustion engine with a fuel injection system comprising a high-pressure pump associated with a quantity control valve having a solenoid valve electromagnetically actuatable by a coil for supplying fuel, the quantity of fuel supplied by the high-pressure pump being controllable by the quantity control valve by means of supplying the coil of the solenoid valve with a first current value in order to close the same for supplying fuel to the high-pressure pump. The first current value can be reduced to a second current value when the solenoid valve is closing in order to at least partially reduce a radiation of audible sound arising from the closing of the solenoid valve during operation of the internal combustion engine.

DETAILED DESCRIPTION

Figure 1:
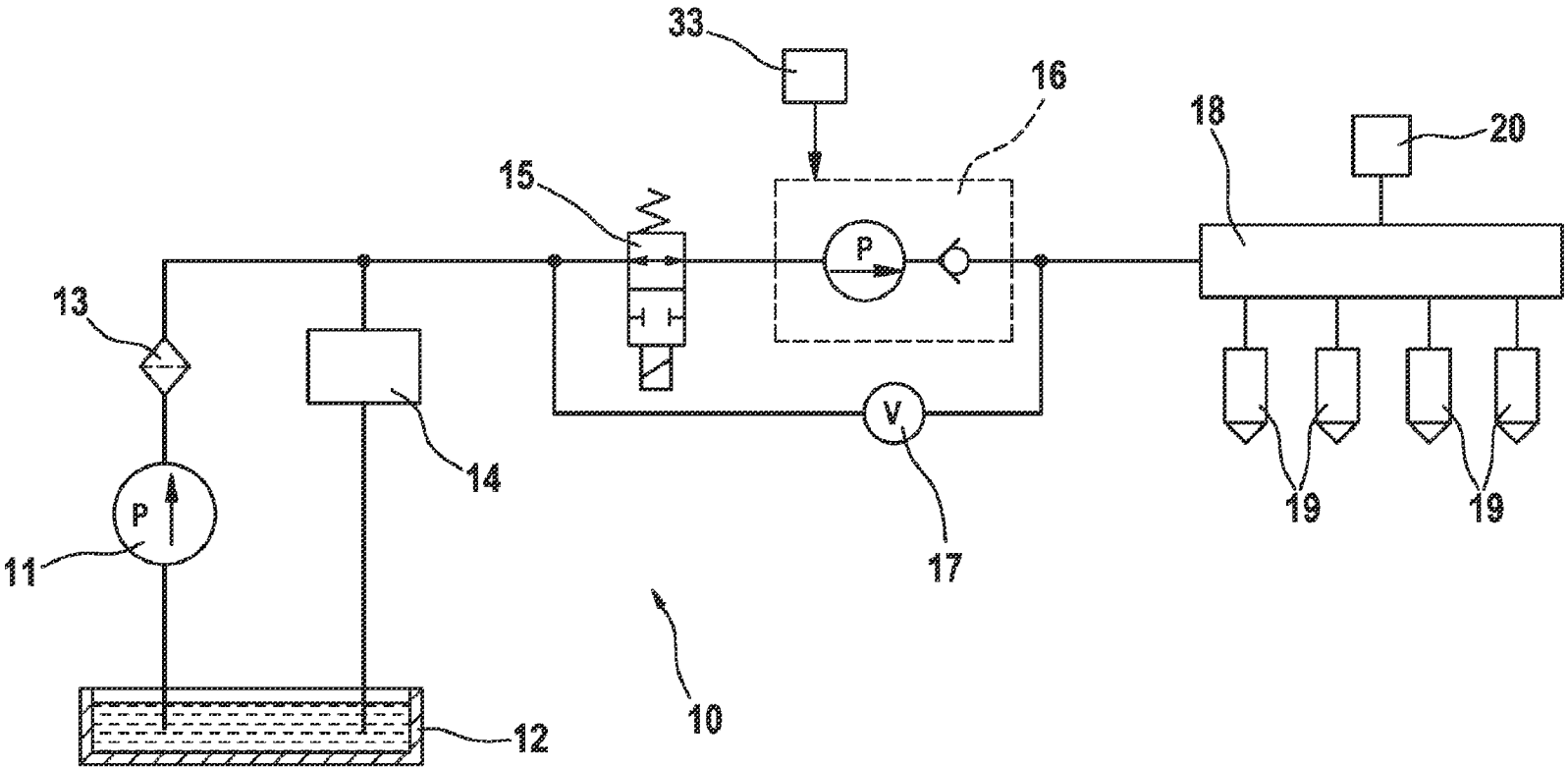
FIG. 1 is a schematic depiction of a fuel injection system of an internal combustion engine with a high-pressure pump and a quantity control valve.

FIG. 1 shows a schematic depiction of a fuel injection system 10 of an internal combustion engine. This comprises an electric fuel pump 11, with which fuel is conveyed from the tank 12 and is pumped further across a fuel filter 13. The fuel pump 11 is suited for the purpose of producing low pressure in the system. A low pressure regulator 14, which is connected to the outlet of the fuel filter 13, is provided for the open-loop and/or closed-loop control of this low pressure. Fuel can be conveyed again back to the fuel tank 12 via said regulator 14. Furthermore, a series connection comprising a quantity control valve 15 and a mechanical high-pressure pump 16 is attached at the outlet of the fuel filter 13. The outlet of the high-pressure pump 16 is led back to the inlet of the quantity control valve 15 via a pressure relief valve17. The outlet of the high-pressure pump 16 is furthermore connected to a pressure reservoir 18, whereat a plurality of injection valves 19 is attached. A pressure regulator 33 specifies a nominal pressure value to be produced by the high-pressure pump 16 for the pressure reservoir 18. The pressure reservoir 18 is also often designated as the rail or common rail. Furthermore, a pressure sensor 20 is attached to the pressure reservoir 18.

In the present example, the fuel injection system 10 depicted in FIG. 1 serves the purpose of supplying the injection valves 19 of a four cylinder internal combustion engine with sufficient fuel and the necessary fuel pressure so that a reliable injection of fuel and a reliable operation of the internal combustion engine is assured.

Figure 2:
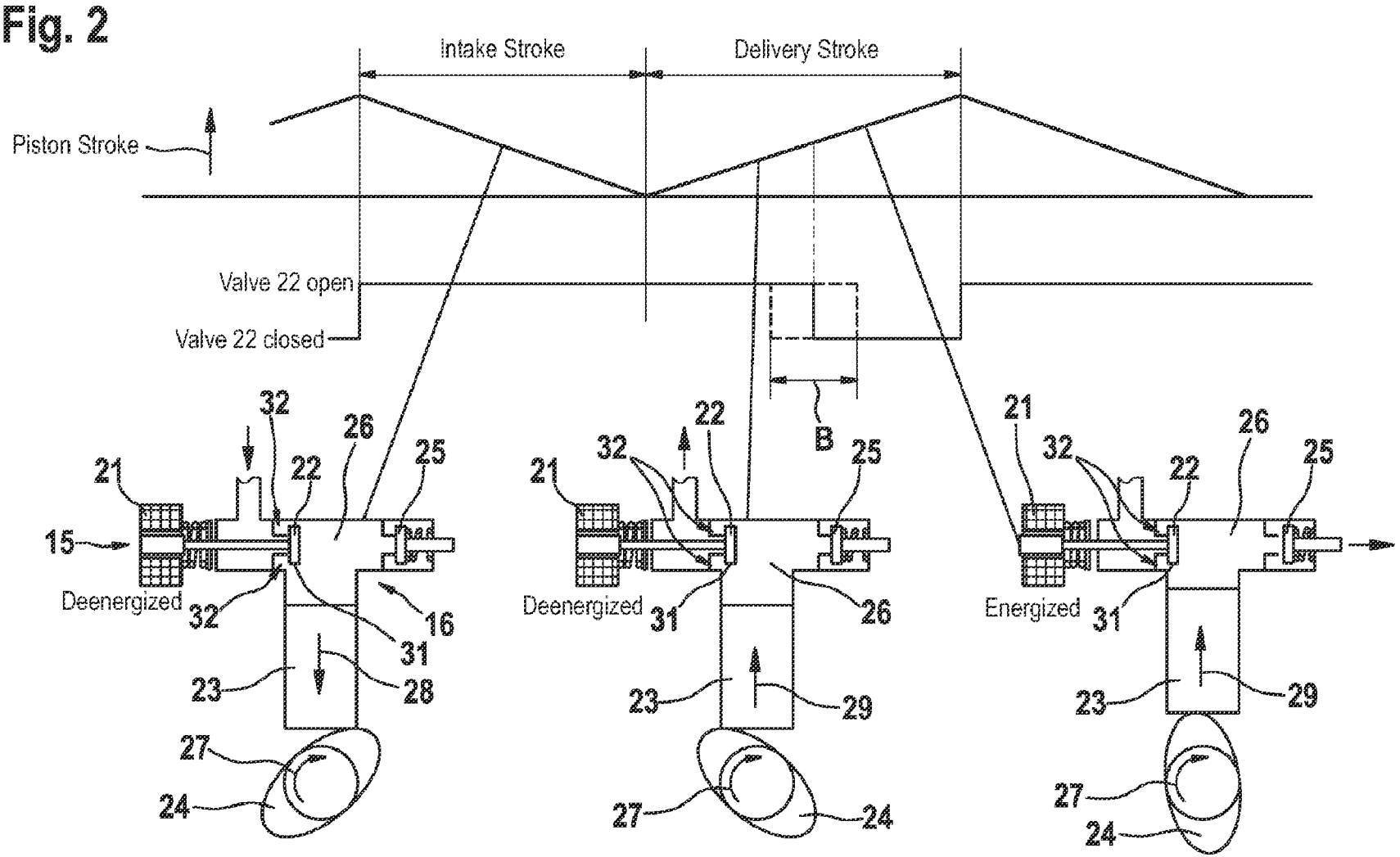
FIG. 2 is a schematic depiction of different functional states of the high-pressure pump from FIG. 1 with an associated time diagram.

The functionality of the quantity control valve 15 and the high-pressure pump 16 is depicted in detail in FIG. 2. The quantity control valve 15 is constructed as a normally open solenoid valve 22 and has a coil 21. The solenoid valve can be closed or opened by applying or switching off an electrical current, respectively an electrical voltage, via said coil 21. The high-pressure pump 16 has a piston 23, which is actuated by a cam 24 of the internal combustion engine. Furthermore, the high-pressure pump 16 is equipped with a valve 25. A conveying chamber 26 of the high-pressure pump 16 is located between the solenoid valve 22, the piston 23 and the valve 25.

With the solenoid valve 22, the conveying chamber 26 can be separated from a fuel feed by the electric fuel pump 11 and thereby from the low pressure. With the valve 25, the conveying chamber 26 can be separated from the pressure reservoir 18 and thereby from the high pressure.

The solenoid valve 22 is open and the valve 25 is closed in the initial state as it is depicted in FIG. 2. The open solenoid valve 22 corresponds to the currentless state of the coil 21. The valve 25 is held closed by the pressure of a spring or something similar.

In the diagram on the left of FIG. 2, the intake stroke of the high-pressure pump 16 is depicted. When the cam 24 rotates in the direction of the arrow 27, the piston 23 moves in the direction of the arrow 28. As a result of the solenoid valve 22 being open, fuel, which has been supplied by the electric fuel pump 11, consequently flows into the conveying chamber 26.

In the diagram in the middle of FIG. 2, the delivery stroke of the high-pressure pump 16 is shown, the coil 21, however, being still without current and the solenoid 22 thereby still being open. As a result of the rotational movements of the cam 24, the piston 23 moves in the direction of the arrow 29. As a result of the solenoid valve 22 being open, fuel is for this reason conveyed out of the conveying chamber 26 and back in the direction of the electric fuel pump 11. This fuel then travels back into the fuel tank 12 via the low pressure regulator 14.

In the diagram on the right of FIG. 2, the delivery stroke of the high-pressure pump 16 is further shown as in the middle diagram. In contrast to the middle diagram, the coil 21 is now energized and the solenoid valve 22 is thereby closed. This results in pressure being built up in the conveying chamber 26 by means of the further stroke movement of the piston 23. When the pressure is achieved, which prevails in the pressure reservoir 18, the valve 25 is opened and the residual quantity is conveyed into the pressure reservoir.

The quantity of the fuel supplied to the pressure reservoir 18 depends upon when the solenoid valve 22 enters into its closed state. The earlier the solenoid valve is closed, the more fuel is conveyed into the pressure reservoir 18 via the valve 25. This is depicted in FIG. 2 by a region B which is designated by an arrow.

As soon as the piston 23 in the diagram on the right of FIG. 2 has reached its point of maximum travel, no further fuel can be conveyed by the piston 23 into the pressure reservoir 18 via the valve 25. The valve 25 closes. Furthermore, the coil 21 is again deenergized so that the solenoid valve opens again. As a reaction to that, the piston, which now moves according to the diagram on the left of FIG. 2 in the direction of the arrow 28, again draws fuel conveyed by the electric fuel pump into the conveying chamber 26.

A method for controlling the fuel injection system 10 of FIG. 1 according to one embodiment of the invention with reference to FIGS. 3 and 4 will be described in detail below.

Figure 3:
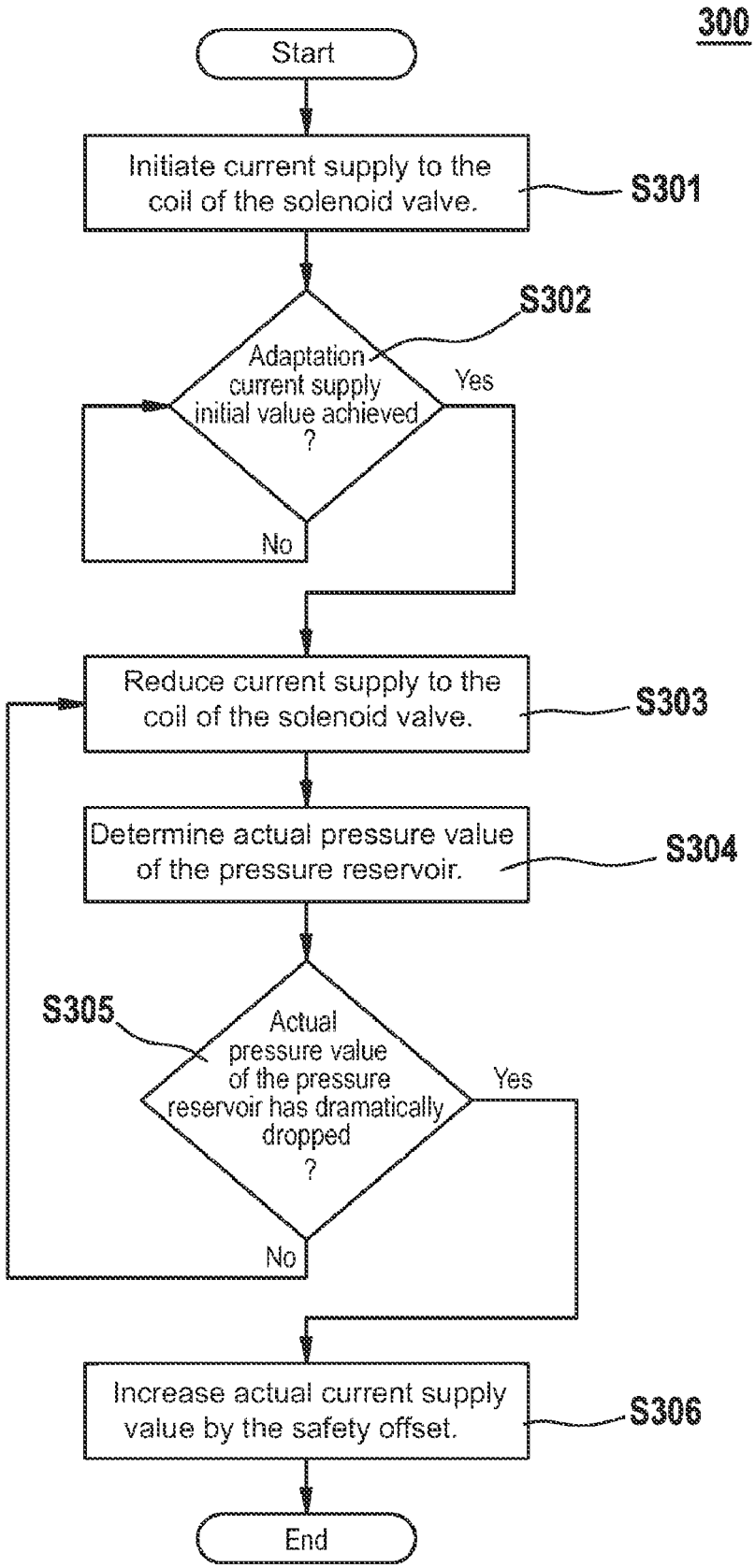
FIG. 3 is a flow chart of a method for controlling the quantity control valve from FIG. 1.

FIG. 3 shows a flow chart of a method 300 for controlling the fuel injection system 10 of the internal combustion engine of FIGS. 1 and 2 to reduce the audible sound, which arises from switching the quantity control valve 15 during the operation of the internal combustion engine. According to a preferred embodiment of the invention, the method 300 is implemented as a computer program which can be executed by a suitable open-loop and closed-loop control device, which is already provided in the internal combustion engine. The invention can therefore be simply and cost effectively implemented with components which are already present in the internal combustion engine.

In the following description of the method according to the invention, a detailed explanation of the procedural steps known in the technical field is foregone.

The method 300 begins at step S301 with the supply of current to the coil 21 of the solenoid valve 22. For this purpose, an activation voltage which is present at the coil 21 can be switched off so that a corresponding current is induced in the coil 21.

In step S302 the coil current of the coil is measured. The measured coil current is then compared with a predetermined adaptation current supply initial value. This can, for example, be determined with the aid of a suitable characteristic curve. As long as the measured coil current is smaller than the predetermined adaptation current supply initial value, the method 300 proceeds with the measurement of the coil current and the comparison of the measured coil current with the predetermined adaptation current supply initial value according to step S302. If the measured coil current is equal to or greater than the predetermined adaptation current supply initial value, the method 300 proceeds to step S303.

In step S303 the current supply to the coil 21 starting at the predetermined adaptation current supply initial value is dropped to a reduced current value. According to one embodiment of the invention, this drop takes place in the form of a decrementation, for example by switching on the activation voltage again which is present at the coil 21.

In step S304 a respective, current actual pressure value of the pressure reservoir 18 is determined, for example by the pressure sensor 20. In step S305 a determination is made, as is explained below, whether the current actual pressure value of the pressure reservoir 18 has dropped dramatically. In the event that this is not the case, the method 300 returns to step S303, where the present current value for the current supply to the coil 21 is again decremented. A plurality of consecutive decrementations can accordingly be carried out, for example by a repeated switching-on and off of the activation voltage present at the coil 21 relative to a predetermined PWM duty cycle.

In order to determine in step S305 whether the current actual pressure value of the pressure reservoir 18 has dramatically dropped, the actual pressure value is according to the invention compared with a nominal pressure value, which is specified by the pressure regulator 33. If the deviation of the actual pressure value from the nominal pressure value exceeds a predetermined threshold value, it is thereby assumed that the actual pressure value has dropped, whereupon the method 300 proceeds to step S306. As an alternative to this, a dramatic drop in the actual pressure value can then also be assumed if the pressure regulator 33 increases the nominal pressure value to such an extent that this increase exceeds a predetermined increase threshold value.

It is assumed in step S306 that in the case that the current value is reduced, with which the coil 21 is supplied with current, a complete closing of the solenoid valve 22 is no longer assured if it can be assumed that the current actual pressure value of the pressure reservoir 18 has dropped dramatically. In the event that the solenoid valve 22 no longer completely closes, the high-pressure pump 16 breaks down, i.e. the fuel conveyance by the high-pressure pump 16 is at least limited to the extent that a sufficient high pressure can no longer be built up in the pressure reservoir 18. Therefore, the present current value supplying current to the coil 21 at this point in time, respectively actual current supply value, is also subsequently referred to as the "breakdown current value".

In order to assure during subsequent operation of the internal combustion engine that the solenoid valve 22 reliably and completely closes in each case, the ascertained breakdown current value is then increased in step S306 by a predetermined safety offset. In so doing, a minimum current value is determined, with which the coil 21 of the solenoid valve 22 is to be supplied with current during the operation of the internal combustion engine in order to reliably and completely close the solenoid valve 22.

During subsequent operation of the internal combustion engine, the current supply to the solenoid valve 22 can consequently be reduced to this minimum current value when an appropriate closing procedure in each case occurs upon achieving the adaptation current supply initial value. Because of this, the actuation time of the solenoid valve 22 is respectively maximized so that the speed at impact of the magnetic armature 31 against the displacement limiting stops 32 is minimized, and as a result the audible sound produced in this connection can be reduced.

Figure 4:
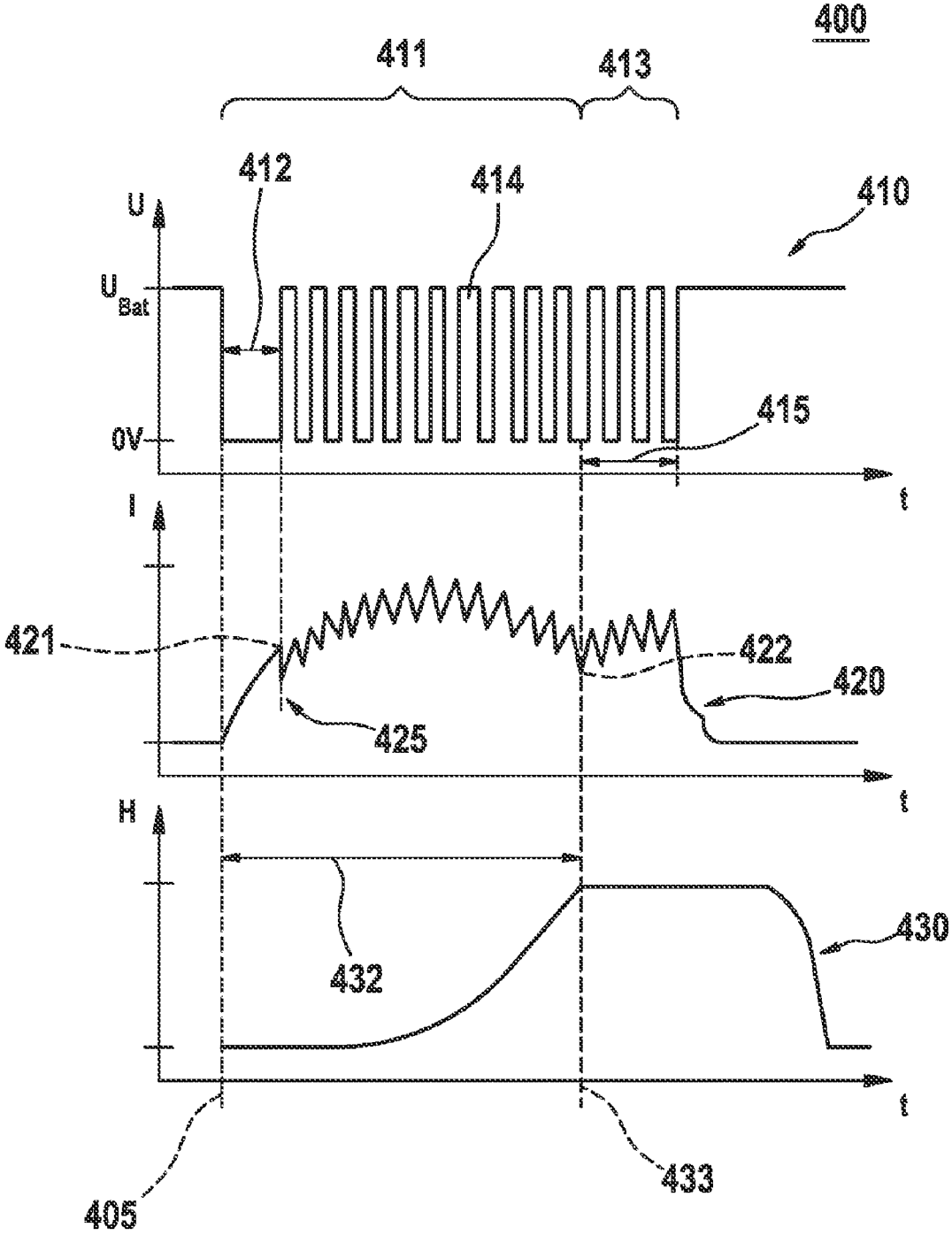
FIG. 4 is a schematic depiction of the temporal progression of the lift of the solenoid valve from FIG. 1 and the activation voltage required for this purpose, respectively the current supply during activation according to the invention.

FIG. 4 shows a diagram 400, which depicts a temporal course 410 of an activation voltage U, a temporal course of a temporal current profile 420 of the current I ensuing from said course 410 as well as a corresponding temporal course 430 of a valve lift H of the quantity control valve 15 from FIG. 1, which was brought about by the current profile 420, respectively a valve lift H of the solenoid valve 22 from FIG. 2 of the fuel injection system 10 from FIG. 1. The diagram 400 illustrates an activation of the solenoid valve 22 according to one embodiment of the invention. Said activation begins at a point in time 405, whereat the activation voltage $U_{Bat}$ present at the coil 21 of the solenoid valve 22 (as described above in reference to step S301 of FIG. 3) is switched off for an actuation pulse length 412. As a result, the current in the coil 21 increases up to a current value 421 up until the point in time 425.

In the present example of embodiment, the current value 421 represents the adaptation current supply initial value according to step S302 of FIG. 3. The adaptation according to the invention accordingly begins at the point in time 424 as described above in reference to step S303 of FIG. 3. The switching-on and off of the activation voltage relative to a predetermined PWM duty cycle 414 is depicted here as in FIG. 4, the adaptation current supply initial value 421 being lowered to a reduced current value 422 up to a point in time 433. An actuation phase 411 required for closing the solenoid valve 22 is concluded at the point in time 433, and the solenoid valve 22 closes so that the point in time 433 is also referred to as the closing time point. As can be seen from the temporal course 420, the reduced current value 422 is then increased by a predetermined safety offset in order to assure a complete closing of the solenoid valve 22.

After the closing of the solenoid valve 22, the same is held closed for a predetermined holding phase 413, whereupon the activation voltage is again set to $U_{Bat}$ up to the next ensuing closing procedure. The time period between the closing of the solenoid valve 22 and the expiration of the holding phase 413 is also denoted by a holding angle 415. The current supply to the solenoid valve 22 consequently drops again so that the same reopens.

As can be seen in FIG. 4, a relatively long actuation phase 411, respectively dead time 432, is implemented during the activation of the solenoid valve 22 according to the invention. In so doing, the speed at impact of the magnetic armature 31 against the displacement limiting stops 32 is reduced and consequently the audible sound produced in this connection is significantly reduced.

Figure 5:
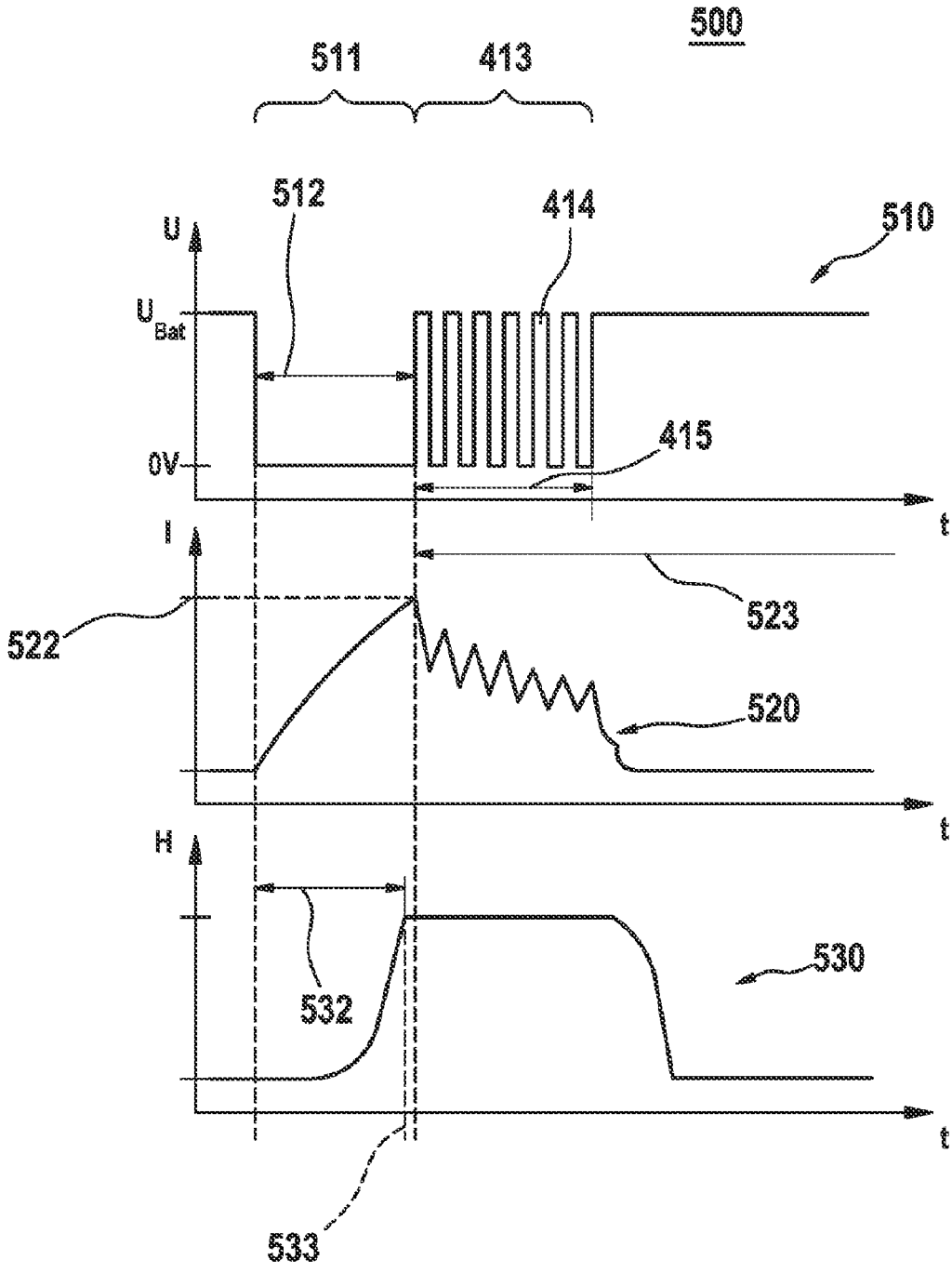
FIG. 5 is a schematic depiction of the temporal progression of the lift of the solenoid valve from FIG. 1 and the activation voltage required for this purpose, respectively the current supply during a conventional activation.

FIG. 5 shows a diagram 500, which for the purpose of comparison depicts a temporal course 510 of an activation voltage U, a temporal course of a temporal current profile 520 of the current I ensuing from said course 510 as well as a corresponding temporal course 530 of a valve lift H of the quantity control valve 15 from FIG. 1, which was brought about by the current profile 520, respectively a valve lift H of the solenoid valve 22 from FIG. 2 of the fuel injection system 10 from FIG. 1 during an activation according to the technical field. As can be seen from FIG. 5, a peak current value 522 in the coil 21, which is larger than the current values achieved according to the invention, is brought about in this instance by a greater actuation pulse length 512 in a shorter actuation phase 511. In so doing, a shorter dead time 532 and consequently a correspondingly earlier closing time point 523 are brought about while the speed at impact is greater so that the magnetic armature 31 strikes harder and correspondingly louder, respectively more audibly, against the displacement limiting stops 32.

The invention claimed is:

1. Method for controlling a fuel injection system of an internal combustion engine, the fuel injection system comprising a high-pressure pump associated with a quantity control valve having a solenoid valve electromagnetically actuatable by a coil for supplying fuel, the quantity control valve controlling a quantity of fuel supplied by the high-pressure pump and the coil of the solenoid valve having a first current value applied thereto, in order to close the same for supplying fuel to the high-pressure pump wherein the first current value is reduced to a second current value when the solenoid valve is closing, such that radiation of audible sound arising from the closing of the solenoid valve during operation of the internal combustion engine is at least partially reduced;

wherein the second current value corresponds to a minimum current value, with which a complete closing of the solenoid valve can be achieved during the operation of the internal combustion engine.

2. The method according to claim 1, the high-pressure pump being connected to a pressure reservoir, whereat at least one injection valve is attached, wherein an actual pressure value of the pressure reservoir is compared with an associated nominal pressure value for determining the minimum current value.

3. The method according to claim 2, wherein a breakdown current value, whereat a deviation of the actual pressure value from the nominal pressure value exceeds a predetermined threshold value, is ascertained for determining the minimum current value, the ascertained breakdown current value being increased by a predetermined safety offset.

4. The method according to claim 1, the high-pressure pump being connected to a pressure reservoir, wherein at least one injection valve is attached and for which a nominal pressure value required for operation is specified by an associated pressure regulator wherein the minimum current value is determined as a function of an increase in the nominal pressure value during operation of the internal combustion engine.

5. The method according to claim 4, wherein a breakdown current value, whereat the increase in the nominal pressure value exceeds a predetermined threshold valve, is ascertained for determining the minimum current value, the ascertained breakdown value being increased by a predetermined safety offset.

6. The method according to claim 1, the solenoid valve having a magnetic armature, which is drawn against associated displacement limiting stops for the closing of the solenoid valve, the audible sound arising from striking of the magnetic armature against the displacement limiting stops wherein an actuation behavior of the magnetic armature is decelerated by reducing the first current value to the second current value in order to reduce a corresponding speed at impact of the magnetic armature against the displacement limiting stops.

7. Computer program encoded in a computer-readable medium for carrying out a method for controlling a fuel injection system of an internal combustion engine, the fuel injection system comprising a high-pressure pump associated with a quantity control valve having a solenoid valve electromagnetically actuatable by a coil for supplying fuel, the quantity control valve controlling a quantity of fuel supplied by the high-pressure pump and the coil of the solenoid valve having a first current value applied thereto, in order to close the same for supplying fuel to the high-pressure pump wherein the first current value is reduced to a second current value when the solenoid valve is closing, such that radiation of audible sound arising from the closing of the solenoid valve during operation of the internal combustion engine is at least partially reduced;

wherein the second current value corresponds to a minimum current value, with which a complete closing of the solenoid valve can be achieved during the operation of the internal combustion engine.

8. Internal combustion engine with a fuel injection system comprising a high-pressure pump associated with a quantity control valve having a solenoid valve electromagnetically actuatable by a coil for supplying fuel, a quantity of fuel supplied by the high-pressure pump being controllable by the quantity control valve supplying the coil of the solenoid valve with a first current value, in order to close the same for supplying fuel to the high-pressure pump wherein the first current value can be reduced to a second current value when the solenoid valve is closing, in order to at least partially reduce a radiation of audible sound arising from the closing of the solenoid valve during operation of the internal combustion engine;

wherein the second current value corresponds to a minimum current value, with which a complete closing of the solenoid valve can be achieved during the operation of the internal combustion engine.

9. Method for controlling a fuel injection system of an internal combustion engine, the fuel injection system comprising a high-pressure pump associated with a quantity control valve having a solenoid valve electromagnetically actuatable by a coil for supplying fuel, the quantity control valve controlling a quantity of fuel supplied by the high-pressure pump and the coil of the solenoid valve having a first current value applied thereto, in order to close the same for supplying fuel to the high-pressure pump wherein the first current value is reduced to a second current value when the solenoid valve is closing, such that radiation of audible sound arising from the closing of the solenoid valve during operation of the internal combustion engine is at least partially reduced;

wherein the high-pressure pump is connected to a pressure reservoir, whereat at least one injection valve is attached, wherein an actual pressure value of the pressure reservoir is compared with an associated nominal pressure value for determining a minimum current value with which a complete closing of the solenoid valve can be achieved during the operation of the internal combustion engine.

10. The method according to claim 9, wherein a breakdown current value, whereat a deviation of the actual pressure value from the nominal pressure value exceeds a predetermined threshold valve, is ascertained for determining the minimum current value, the ascertained breakdown current value being increased by a predetermined safety offset.

11. The method according to claim 10, wherein a breakdown current value, whereat the increase in the nominal pressure value exceeds a predetermined threshold valve, is ascertained for determining the minimum current value, the ascertained breakdown value being increased by a predetermined safety offset.

12. The method according to claim 9, the solenoid valve having a magnetic armature, which is drawn against associated displacement limiting stops for the closing of the solenoid valve, the audible sound arising from striking of the magnetic armature against the displacement limiting stops wherein an actuation behavior of the magnetic armature is decelerated by reducing the first current value to the second current value in order to reduce a corresponding speed at impact of the magnetic armature against the displacement limiting stops.

* * * * *

UNITED STATES PATENT AND TRADEMARK OFFICE

CERTIFICATE OF CORRECTION

PATENT NO. : 8,402,952 B2
APPLICATION NO. : 12/670890
DATED : March 26, 2013
INVENTOR(S) : Haaf et al.

It is certified that error appears in the above-identified patent and that said Letters Patent is hereby corrected as shown below:

In the Specifications

Col. 1, line 9: "priority in made to each" should read --priority is made to each--

In the Claims

Col. 7, lines 56-57, claim 1: "for supplying fuel to the high-pressure" should read --for supplying the fuel to the high-pressure--

Col. 7, line 65, claim 1, the last claim element is missing: "combustion engine." should read --combustion engine; and wherein a breakdown current value, whereat a pressure deviation from a nominal pressure value exceeds a predetermined threshold value, is ascertained for determining the minimum current value, the ascertained breakdown current value being increased by a predetermined safety offset.--

Cols. 7-8, original claim 3, now claim 2 is missing amendments from an amendment filed September 11, 2012. Claim 2 should read --The method according to claim 1, wherein the high-pressure pump is connected to a pressure reservoir whereat at least one injection valve is attached, wherein an actual pressure value of the pressure reservoir is compared with the associated nominal pressure value for determining the minimum current value.--

Col. 8, original claim 4, now claim 3 is missing amendments from an amendment filed September 11, 2012. Claim 3 should read --The method according to claim 2, wherein the pressure deviation is a deviation of the actual pressure value from the nominal pressure value.--

Col. 8, original claim 5, now claim 4 is missing amendments from an amendment filed September 11, 2012. Claim 4 should read --The method according to claim 1, wherein the high-pressure pump is connected to a pressure reservoir whereat at least one injection valve is attached and for which the nominal pressure value required for operation is specified by an associated pressure regulator, wherein the minimum current value is determined as a function of an increase in the Signed and Sealed this
Twenty-fifth Day of March, 2014

Michelle K. Lee

Michelle K. Lee
*Deputy Director of the United States Patent and Trademark Office* nominal pressure value during operation of the internal combustion engine.--

Col. 8, original claim 6, now claim 5 is missing amendments from an amendment filed September 11, 2012. Claim 5 should read --The method according to claim 4, wherein the pressure deviation is the increase in the nominal pressure value.--

Col. 8, line 45, claim 7: "for supplying fuel to the high-pressure" should read --for supplying the fuel to the high-pressure--

Col. 8, line 54, claim 7, the last claim element is missing: "combustion engine." should read --combustion engine; and wherein a breakdown current value, whereat a pressure deviation from a nominal pressure value exceeds a predetermined threshold value, is ascertained for determining the minimum current value, the ascertained breakdown current value being increased by a predetermined safety offset.--

Col. 8, line 62, claim 8: "supplying fuel to the high-pressure" should read --supplying the fuel to the high-pressure--

Col. 9, line 4, claim 8, the last claim element is missing: "combustion engine." should read --combustion engine; and wherein a breakdown current value, whereat a pressure deviation from a nominal pressure value exceeds a predetermined threshold value, is ascertained for determining the minimum current value, the ascertained breakdown current value being increased by a predetermined safety offset.--

Col. 9, lines 12-13, claim 9: "for supplying fuel to the high-pressure" should read --for supplying the fuel to the high-pressure--

Col. 9, lines 24-25, claim 9, the last claim element is missing: "combustion engine." should read --combustion engine; and wherein at least one injection valve is attached to the pressure reservoir and wherein the nominal pressure value required for operation is specified by an associated pressure regulator wherein the minimum current value is determined as a function of an increase in the nominal pressure value during the operation of the internal combustion engine.--

Col. 10, lines 9-10, claim 11: "threshold valve, is ascertained for" should read --threshold value, is ascertained for--

Col. 10, line 11, claim 11: "ascertained breakdown value being" should read --ascertained breakdown current value being--